US010994809B2

(12) United States Patent
Desautels

(10) Patent No.: US 10,994,809 B2
(45) Date of Patent: May 4, 2021

(54) ARCHED STRUCTURE FOR WATERCRAFT

(71) Applicant: Leo Henri Desautels, Mississauga (CA)

(72) Inventor: Leo Henri Desautels, Mississauga (CA)

( * ) Notice: Subject to any disclaimer, the term of this patent is extended or adjusted under 35 U.S.C. 154(b) by 0 days.

(21) Appl. No.: 15/614,100

(22) Filed: Jun. 5, 2017

(65) Prior Publication Data

US 2018/0346071 A1 Dec. 6, 2018

(51) Int. Cl.
*B63B 17/02* (2006.01)
*B63B 17/00* (2006.01)

(52) U.S. Cl.
CPC ..... *B63B 17/023* (2013.01); *B63B 17/02* (2013.01); *B63B 2017/0045* (2013.01)

(58) Field of Classification Search
CPC . B63B 17/02; B63B 17/023; B63B 2017/026; E04H 15/06; E04H 15/08
See application file for complete search history.

(56) References Cited

U.S. PATENT DOCUMENTS 745,656 A 12/1903 Paine
2,864,391 A * 12/1958 Stark ..... B63B 17/02 114/361
3,354,892 A 11/1967 Frieder
3,510,998 A 5/1970 Cianflone
4,075,723 A 2/1978 Bareis et al.
5,070,807 A 12/1991 Lewis
5,253,667 A 10/1993 Chung
5,449,032 A 9/1995 Blevins et al.
5,850,799 A 12/1998 Geisel et al.
6,082,285 A * 7/2000 Hinrichs ..... B63B 17/02 114/343
6,129,034 A 10/2000 Santa Cruz et al.
6,260,505 B1 7/2001 Polidan
6,725,871 B1 4/2004 Shearer et al.
6,789,495 B2 9/2004 Brower et al.
7,111,578 B2 9/2006 Brooks et al.
7,424,862 B1 9/2008 Wagner
7,555,994 B1 7/2009 Arnall
8,365,751 B2 2/2013 Clampitt
8,757,185 B1 * 6/2014 Muzzio ..... B63B 17/02 135/88.01
8,950,416 B1 2/2015 Spellman
9,027,499 B1 5/2015 Clarke

FOREIGN PATENT DOCUMENTS

EP 1970301 9/2008

* cited by examiner

*Primary Examiner* — Andrew Polay

(57) ABSTRACT

An apparatus includes a bendable elongated assembly extendable over a watercraft. A coupler assembly is configured to couple the bendable elongated assembly to the watercraft. An engagement assembly configured to engage the bendable elongated assembly. This is done in such a way that the engagement assembly, in use, urges the bendable elongated assembly to bend and form an arched structure positioned over the watercraft once the bendable elongated assembly is extended over the watercraft and is coupled to the watercraft.

3 Claims, 10 Drawing Sheets

ARCHED STRUCTURE FOR WATERCRAFT

TECHNICAL FIELD

Figure 1:
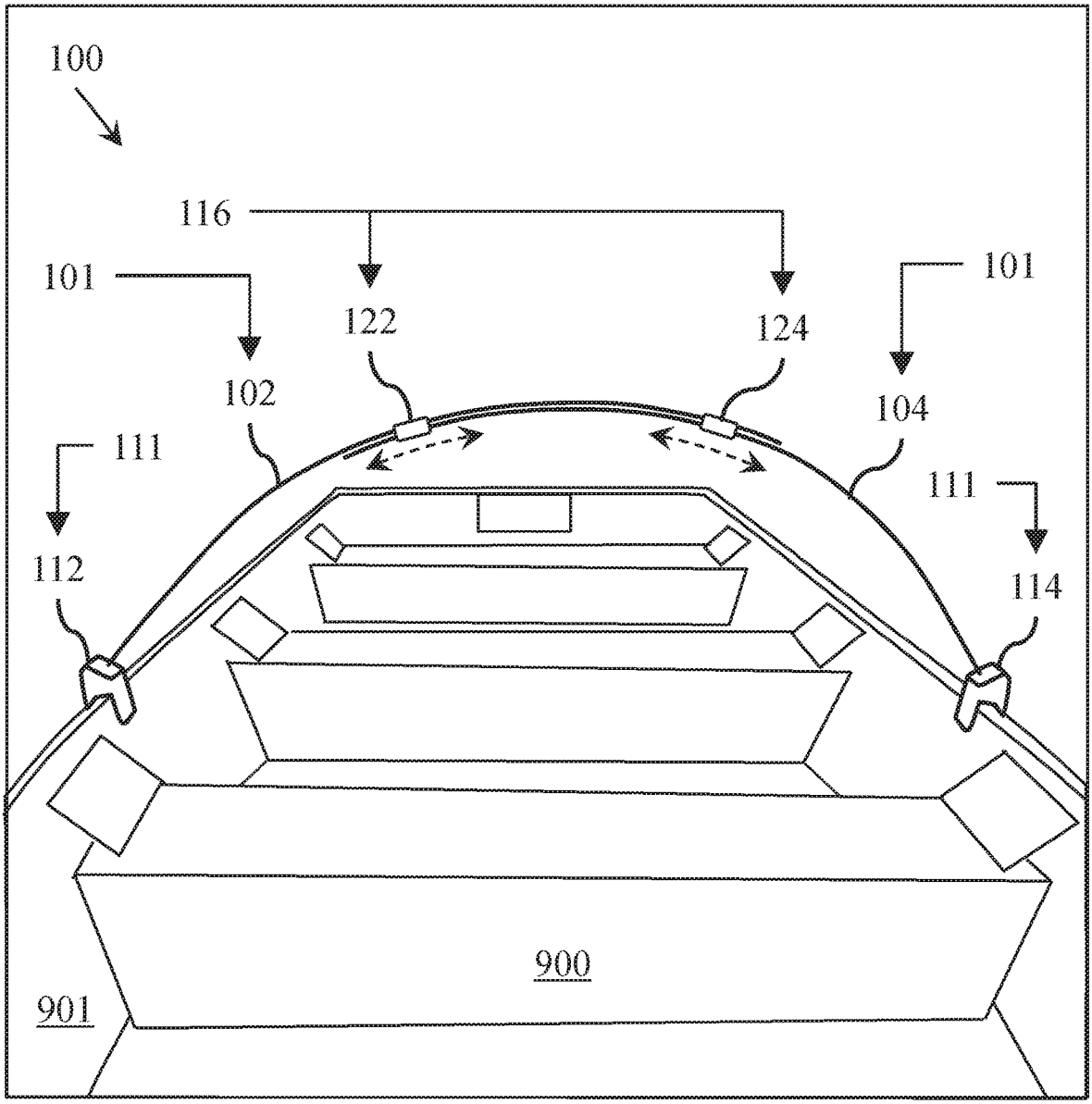

This document relates to the technical field of (and is not limited to) an arched structure for a watercraft (and method therefor).

BACKGROUND

A watercraft cover or enclosure is configured to protect a section of a watercraft (such as a boat) from the weather. It will be appreciated that some watercraft covers are configured to create a more comfortable environment for a user of the watercraft (if desired).

SUMMARY

It will be appreciated that there exists a need to mitigate (at least in part) at least one problem associated with the existing systems (also called the existing technology) configured to support (for supporting) a watercraft cover over a watercraft. After much study of the known systems and methods with experimentation, an understanding of the problem and its solution has been identified and is articulated as follows:

Known watercraft covers are configured to protect watercrafts, whether at anchor, at a dock or in storage (such as, on a trailer, etc.). Known watercraft covers range from a tarp to a framed canopy (essentially a portable fixed-frame structure made from metal tubing and fabric, etc.). Known watercraft covers are configured to prevent water, leaves and debris from falling into the watercraft. Known watercraft covers are typically custom-made fixed-frame structures that are not easily adaptable for installation to a variety of (types) watercrafts.

What may be needed is an apparatus configured to (A) support a watercraft cover, and (B) facilitate (adapt or accommodate) installation or resized installation to a watercraft (or to a wider variety of watercrafts).

To mitigate, at least in part, at least one problem associated with the existing technology, there is provided (in accordance with a first major aspect) an apparatus. The apparatus includes and is not limited to (comprises) a synergistic combination of a bendable elongated assembly, a coupler assembly and an engagement assembly. The bendable elongated assembly is extendable over a watercraft. For instance, the bendable elongated assembly may include a first bendable elongated member and a second bendable elongated member. The coupler assembly is configured to couple the bendable elongated assembly to the watercraft. For instance, the coupler assembly includes a first coupler and a second coupler. The engagement assembly is configured to engage the bendable elongated assembly. This is done in such a way that the engagement assembly, in use, urges the bendable elongated assembly to bend and form an arched structure positioned over the watercraft once the bendable elongated assembly is extended over the watercraft and is coupled to the watercraft.

To mitigate, at least in part, at least one problem associated with the existing technology, there is provided (in accordance with a second major aspect) an apparatus. The apparatus includes and is not limited to (comprises) a synergistic combination of a first bendable elongated member, a second bendable elongated member, a first coupler, a second coupler, and an engagement assembly. The first bendable elongated member and the second bendable elongated member are extendable over a watercraft. The first coupler and the second coupler are configured to couple the first bendable elongated member and the second bendable elongated member, respectively, to the watercraft. The engagement assembly is configured to engage the first bendable elongated member and the second bendable elongated member with each other. The first bendable elongated member and the second bendable elongated member are each configured to bend and form an arched structure positioned over the watercraft once the first bendable elongated member and the second bendable elongated member are extended over the watercraft, are coupled to the watercraft, and are engaged with each other.

To mitigate, at least in part, at least one problem associated with the existing technology, there is provided (in accordance with a third major aspect) an apparatus. The apparatus includes and is not limited to (comprises) a synergistic combination of a first bendable elongated member, a second bendable elongated member, a first coupler, a second coupler, and an engagement assembly. The first bendable elongated member is extendable from a first gunnel (also called a first section side) toward a second gunnel (also called a second section side) of a watercraft. The second bendable elongated member is extendable from the second gunnel toward the first gunnel of the watercraft. The first coupler is configured to couple the first bendable elongated member to the first gunnel of the watercraft. The second coupler is configured to couple the second bendable elongated member to the second gunnel of the watercraft. The engagement assembly is configured to engage the first bendable elongated member with the second bendable elongated member. the first bendable elongated member and the second bendable elongated member are each configured to bend and form an arched structure positioned over the watercraft once: (A) the first bendable elongated member, in use, extends from the first gunnel toward the second gunnel of the watercraft, (B) the second bendable elongated member, in use, extends from the second gunnel toward the first gunnel of the watercraft, (C) the first coupler, in use, couples the first bendable elongated member to the first gunnel of the watercraft, (D) the second coupler, in use, couples the second bendable elongated member to the second gunnel of the watercraft, and (E) the engagement assembly, in use, engages the first bendable elongated member with the second bendable elongated member.

It will be appreciated that the apparatus may be usable for different boat beam widths.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

DETAILED DESCRIPTION OF THE DRAWINGS

Figure 2:
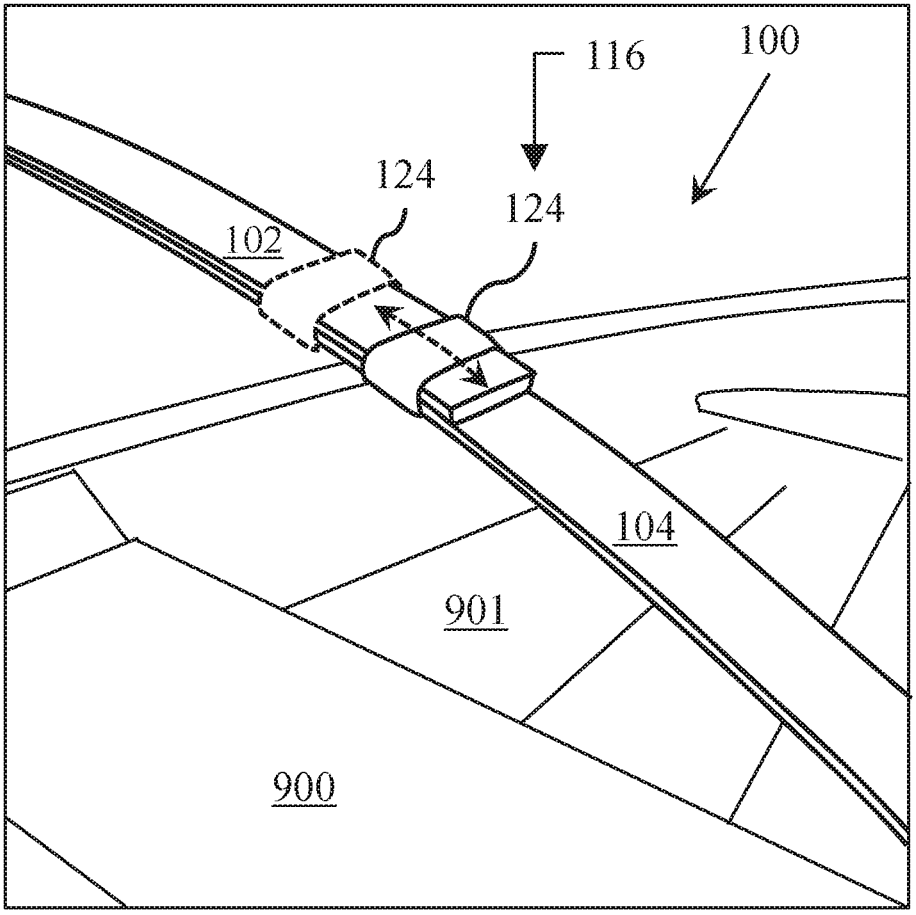
Figure 3:
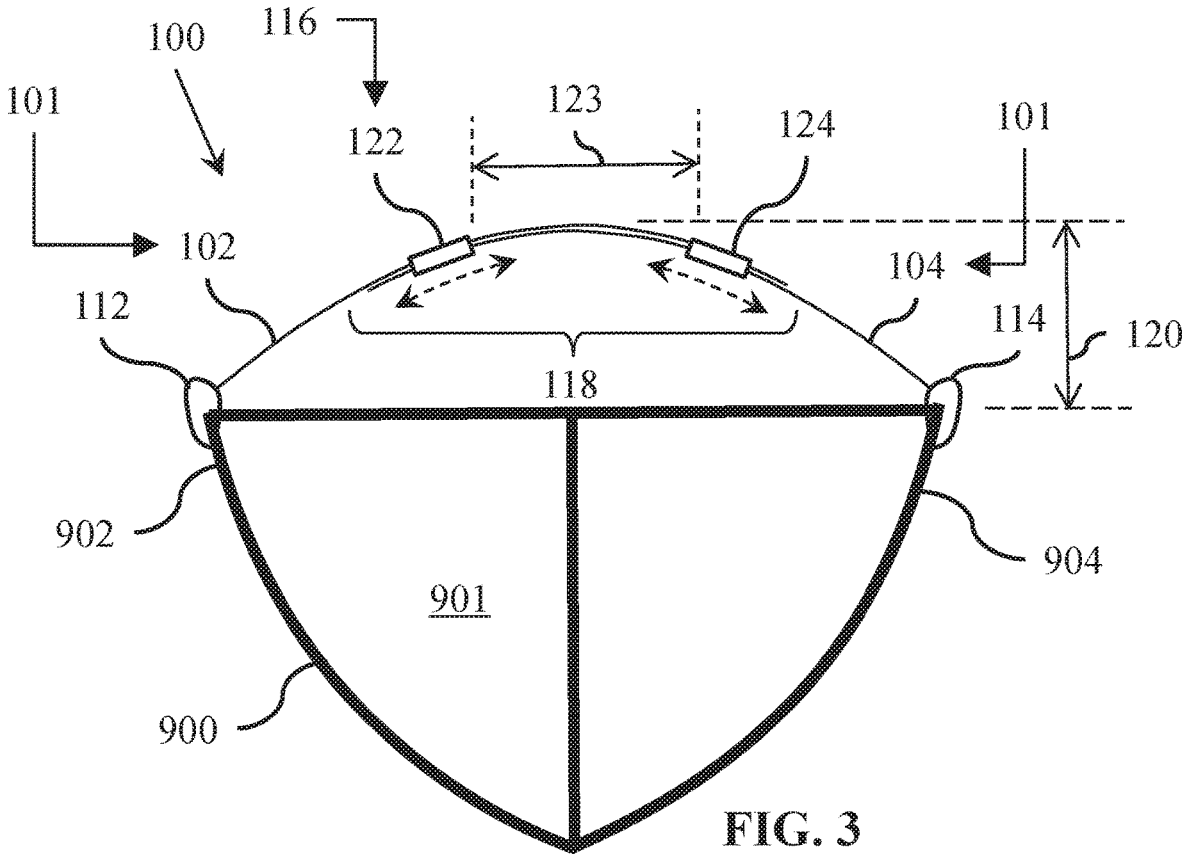
Figure 4:
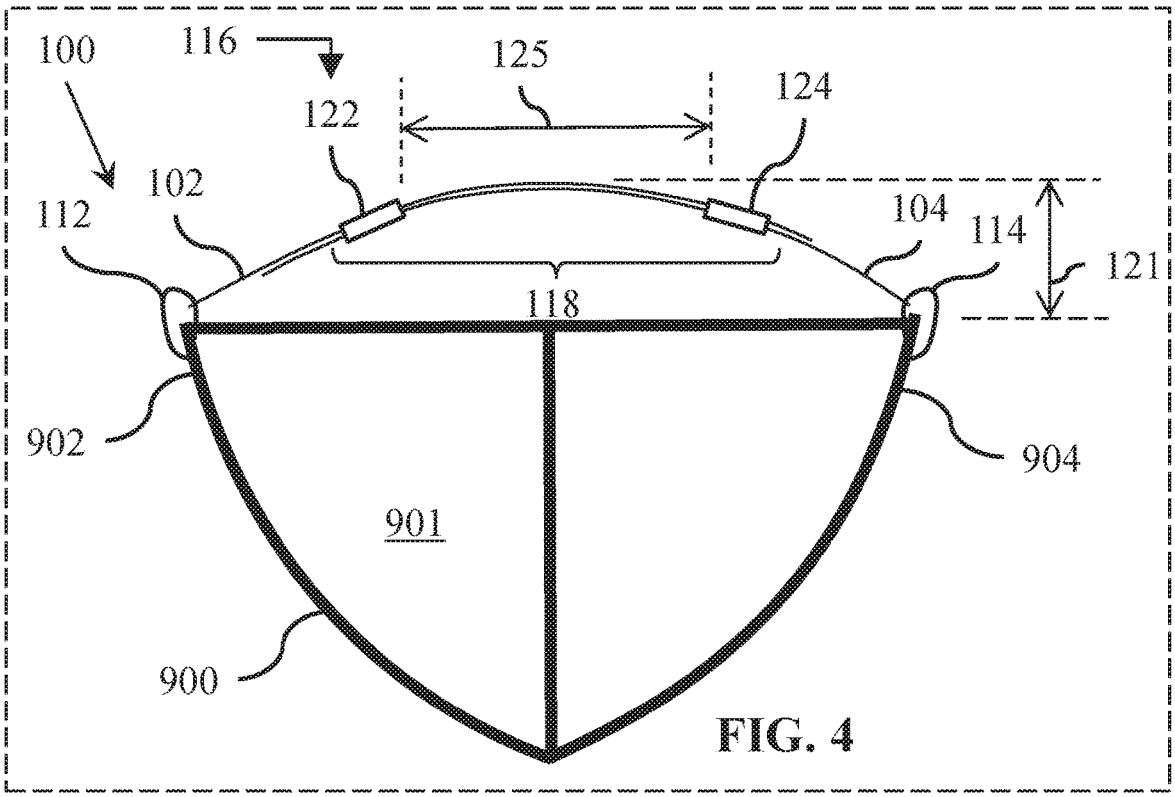
Figure 5:
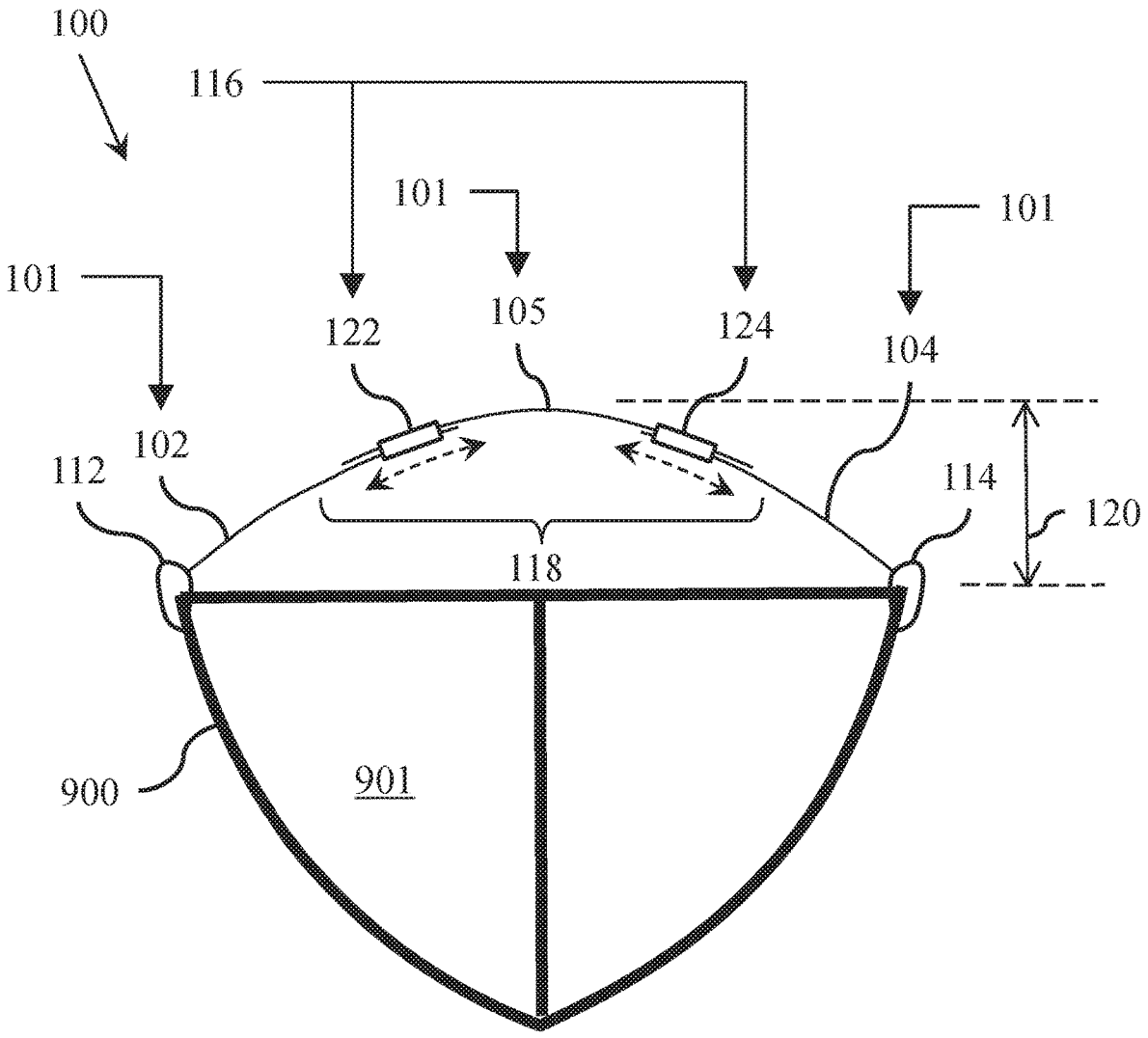
Figure 6:
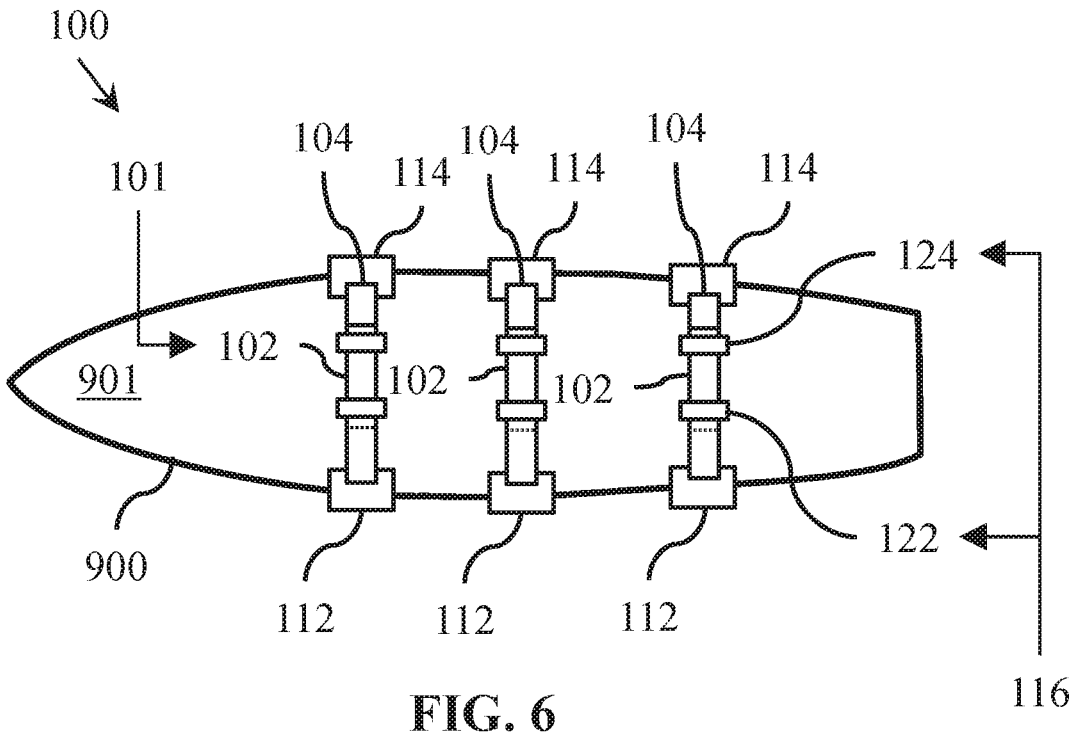
Figure 7:
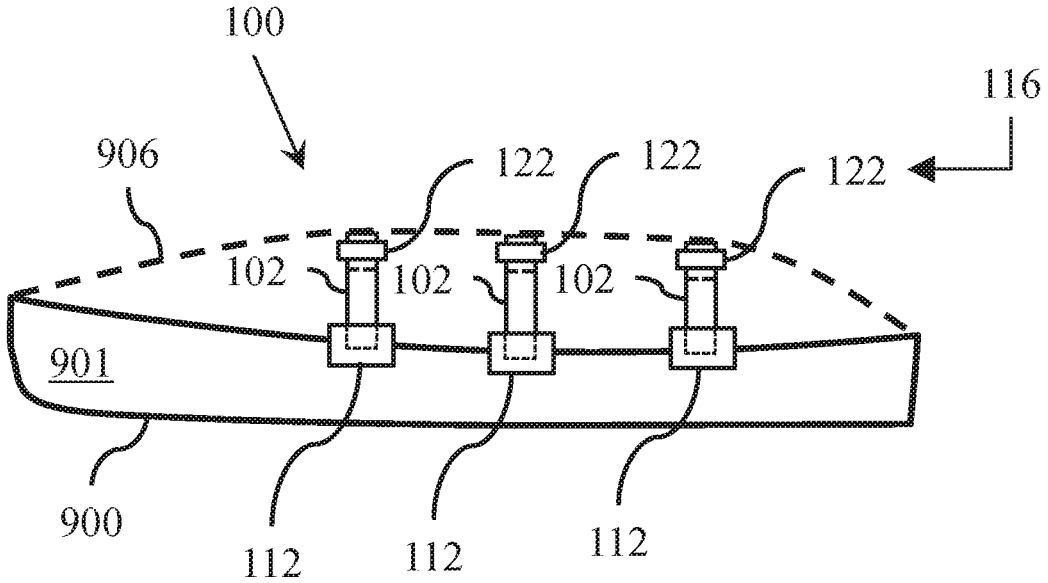
Figure 8:
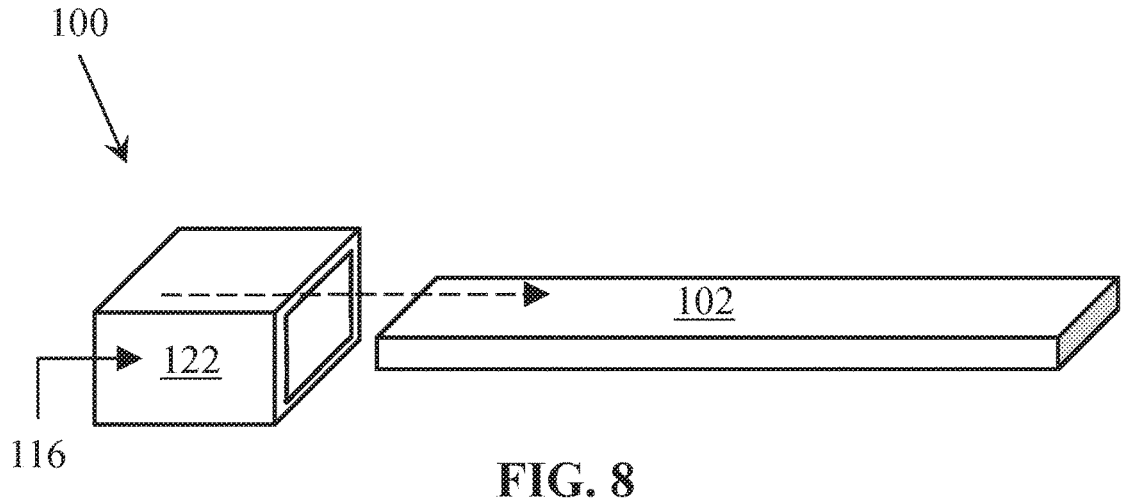
Figure 9:
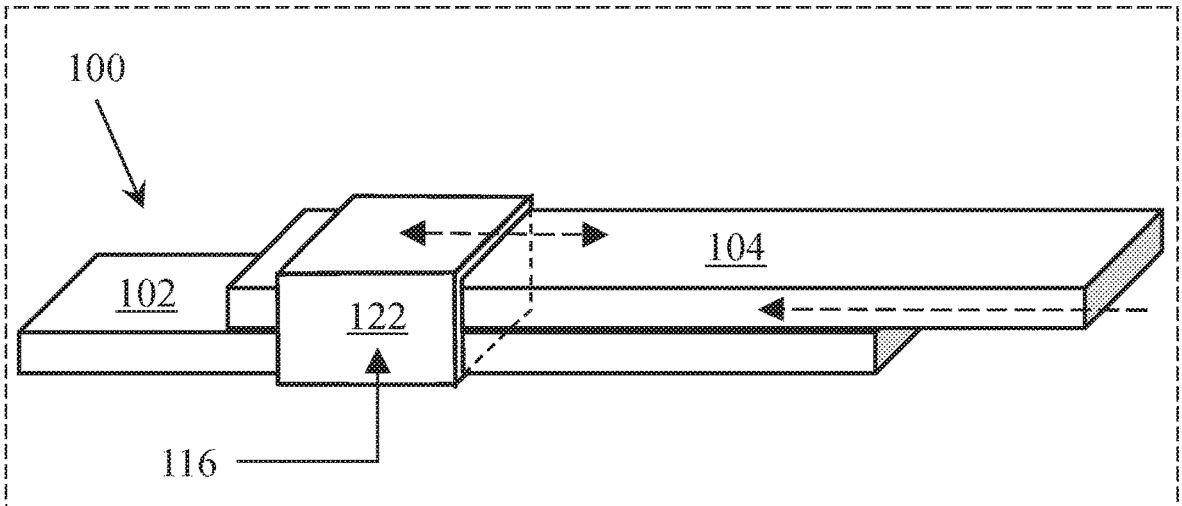
Figure 10:
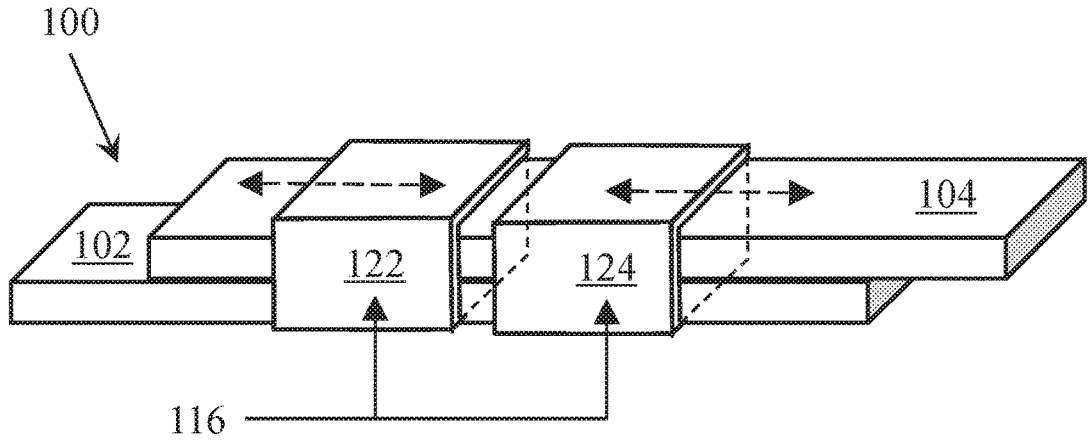
Figure 11:
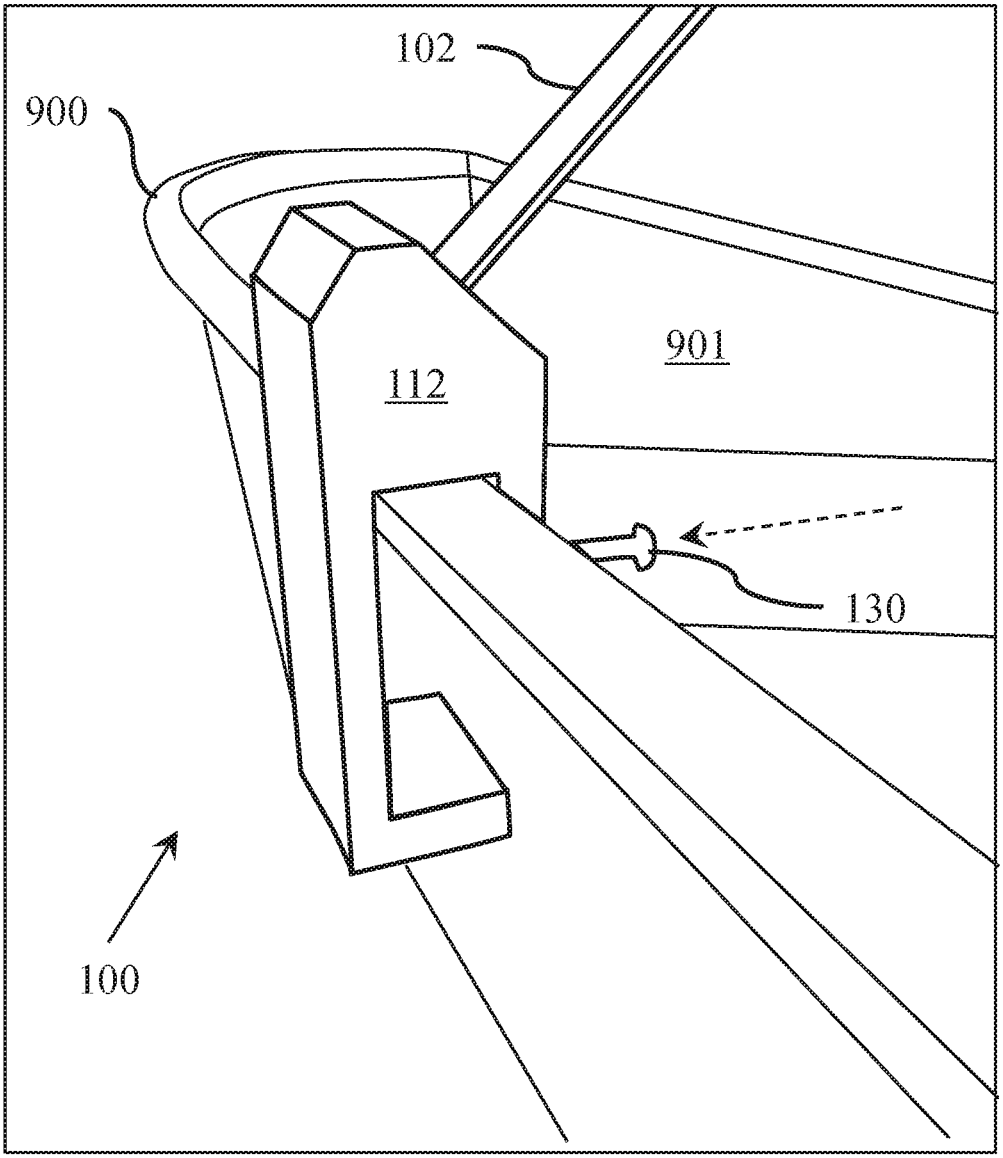
Figure 12:
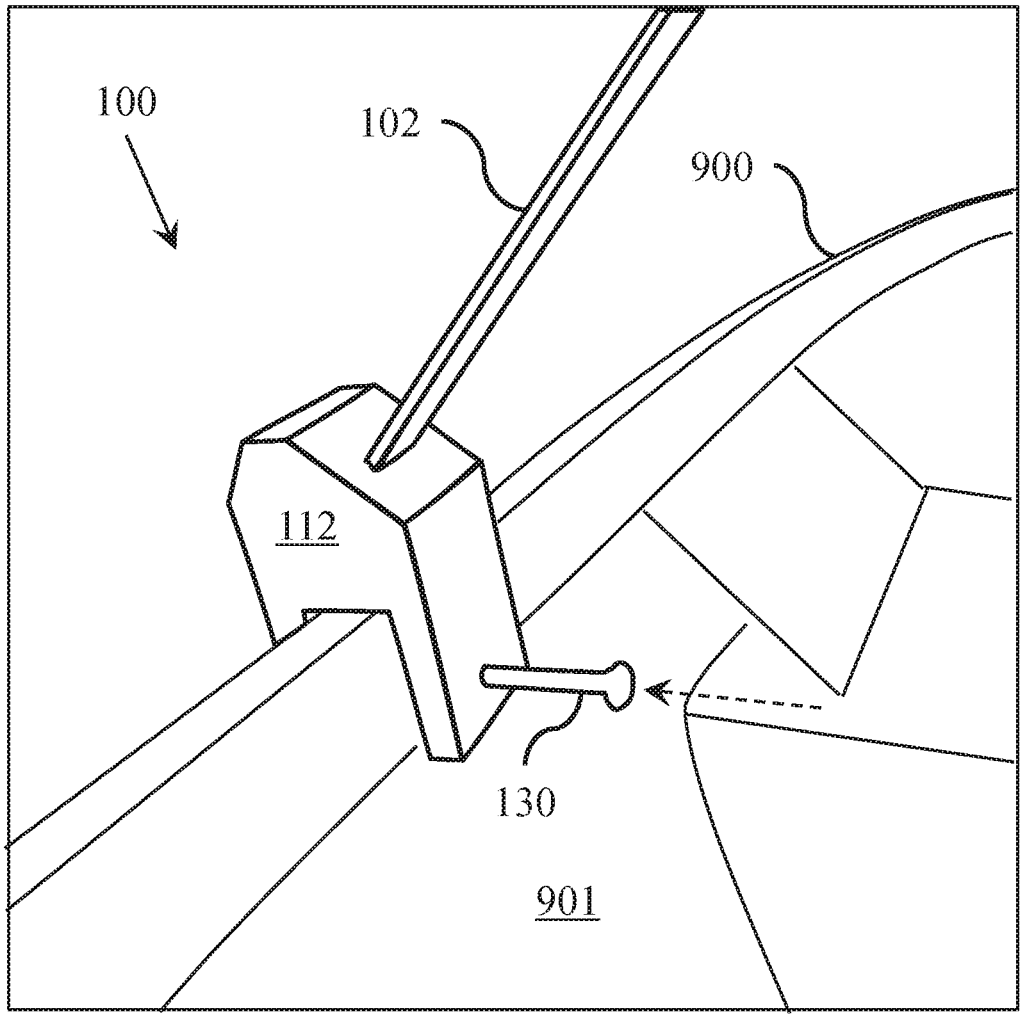
Figure 13:
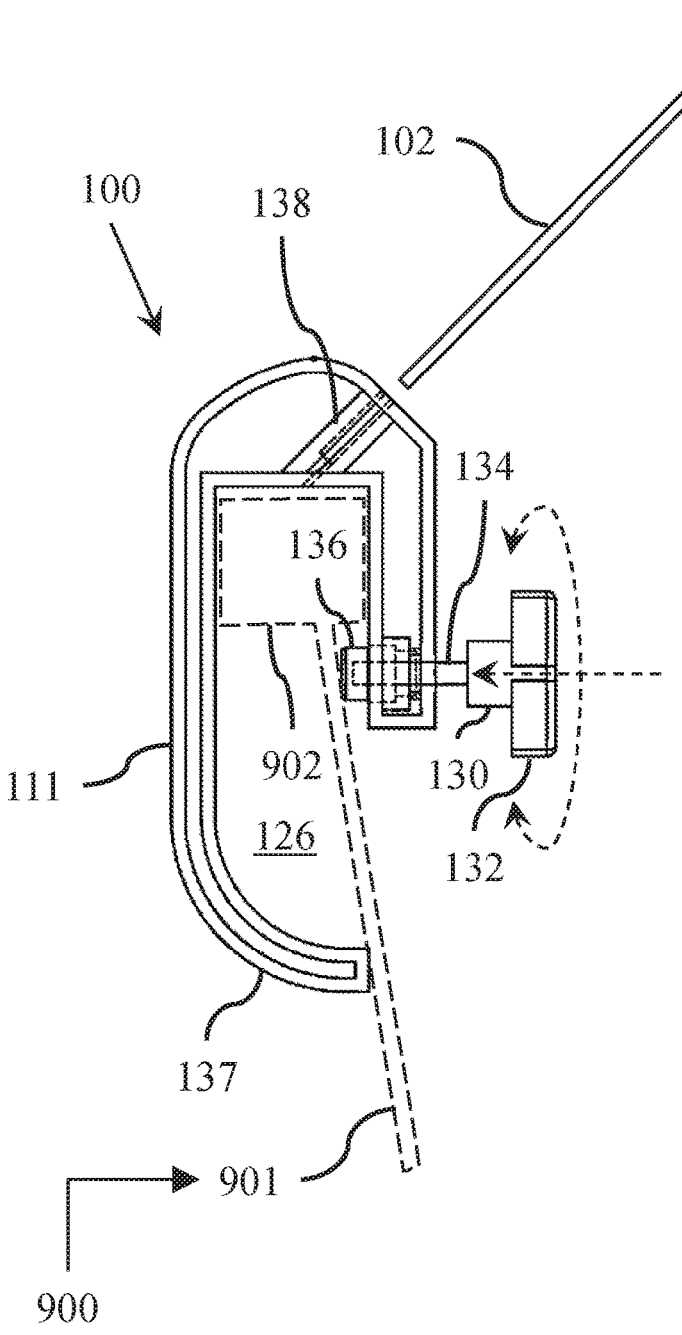
Figure 14:
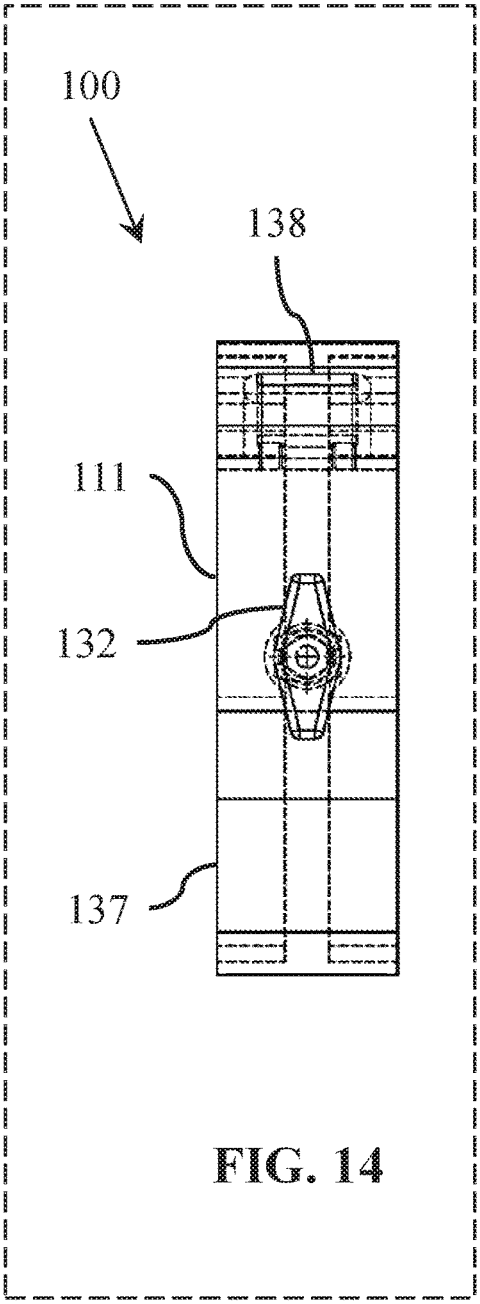
Figure 15:
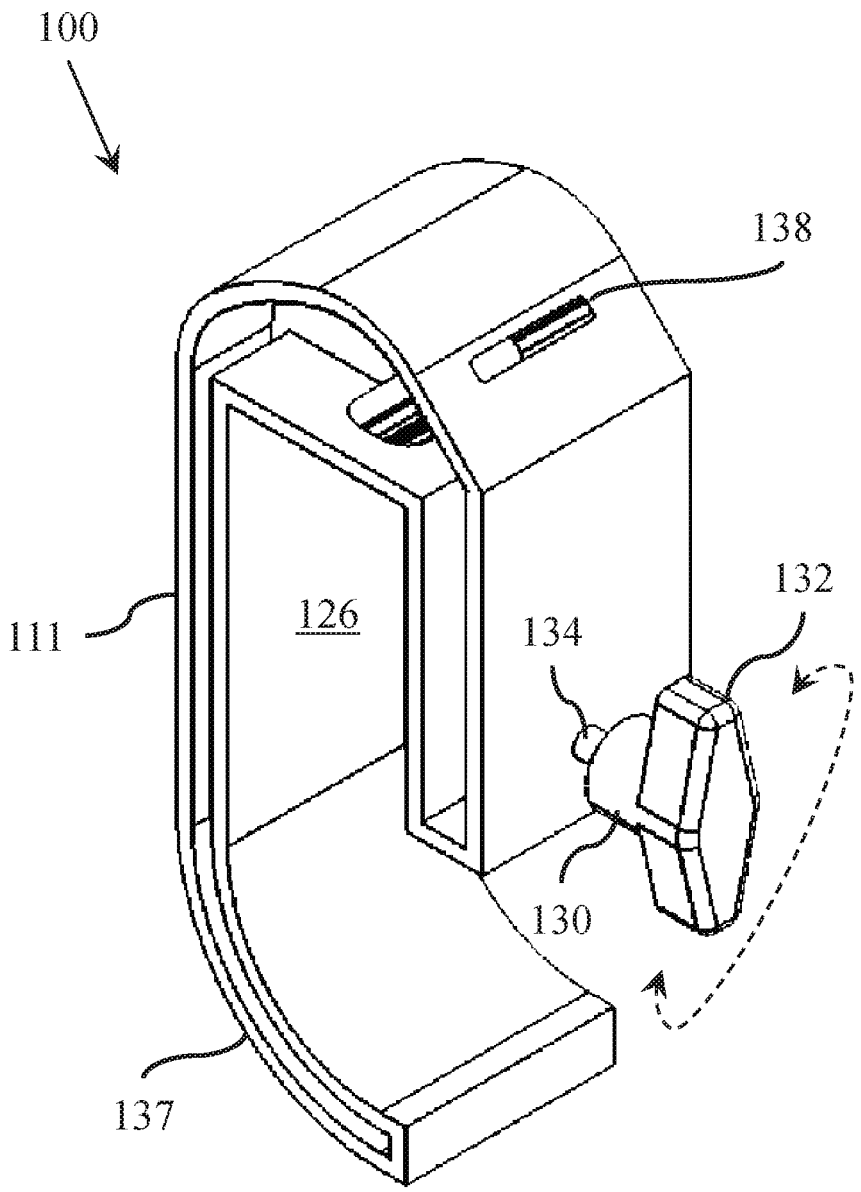

The non-limiting embodiments may be more fully appreciated by reference to the following detailed description of the non-limiting embodiments when taken in conjunction with the accompanying drawings, in which:

FIG. 1 depicts a perspective view of an embodiment of an apparatus including a first bendable elongated member and a second bendable elongated member for a watercraft; and FIG. 2 depicts a perspective view of an embodiment of the apparatus of FIG. 1; and FIG. 3 and FIG. 4 depict end views of embodiments of the apparatus of FIG. 1; and FIG. 5 depict an end view of an embodiments of the apparatus of FIG. 1; and FIG. 6 and FIG. 7 depict a top view (FIG. 6) and a side view (FIG. 7) of embodiments of the apparatus of FIG. 1; and FIG. 8, FIG. 9 and FIG. 10 depict perspective views of embodiments of the apparatus of FIG. 1; and FIG. 11 and FIG. 12 depict perspective view of the apparatus of FIG. 1; and FIG. 13 and FIG. 14 depict a front view (FIG. 13) and a side view (FIG. 14) of embodiments of the apparatus of FIG. 1; and FIG. 15 depicts a perspective view of an embodiment of the apparatus of FIG. 1.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 apparatus
101 bendable elongated assembly
102 first bendable elongated member
104 second bendable elongated member
105 third bendable elongated member
111 coupler assembly
112 first coupler
114 second coupler
116 engagement assembly
118 arched structure
120 vertical height
121 vertical height
122 first engagement device
123 horizontal distance
125 horizontal distance
124 second engagement device
126 gunnel-receiving zone
130 clamp assembly
132 handle assembly
134 rotatable shaft
136 protection portion
137 extension member
138 receiver
900 watercraft
901 hull
902 first gunnel
904 second gunnel
906 watercraft cover

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of may be defined by the claims (in which the claims may be amended during patent examination after filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described. It will be appreciated that, for instance, the scope of the meaning of a device configured to be coupled (connected, interact with, etc.) to an item is to be interpreted as the device is configured to be coupled (connected, interact with, etc.), either directly or indirectly, to the item. Therefore, "configured to" may include the meaning "either directly or indirectly" unless specifically stated otherwise.

FIGS. 1 and 2 depict a rear perspective view (FIG. 1) and a front perspective view (FIG. 2) of embodiments of an apparatus 100. The apparatus 100 is configured to form (provide) an arched structure 118 to be positioned over a watercraft 900.

Referring to the embodiment (in accordance with a first major embodiment) as depicted in FIG. 1, the apparatus 100 includes and is not limited to (comprises) a synergistic combination of a bendable elongated assembly 101, a coupler assembly 111 and an engagement assembly 116. The bendable elongated assembly 101 is extendable over a watercraft 900. For instance, the bendable elongated assembly 101 may include a first bendable elongated member 102 and a second bendable elongated member 104, etc. (in which the bendable elongated members are slide movable, and/or slide contactable, relative to each other). It will be appreciated that the apparatus 100 may be usable for different boat beam widths.

The coupler assembly 111 is configured to couple the bendable elongated assembly 101 to the watercraft 900 (such as, to the top section of the watercraft 900). For instance, the coupler assembly 111 may include a first coupler 112 (for the first bendable elongated member 102) and a second coupler 114 (for the second bendable elongated member 104).

The engagement assembly 116 is configured to engage the bendable elongated assembly 101 (such as, for slide engagement of the first bendable elongated member 102 and the second bendable elongated member 104 with each other). For instance, the engagement assembly 116 may include a first engagement device 122 (also called a first slide engagement device) and a second engagement device 124 (also called a second slide engagement device). The first engagement device 122 may be utilized for slide engaging an end portion of the first bendable elongated member 102 with a section (also called a second lineal section) of the second bendable elongated member 104. The second engagement device 124 may be utilized for slide engaging an end portion of the second bendable elongated member 104 with a section (also called a first lineal section) of the first bendable elongated member 102. By reference to the embodiments as depicted in FIG. 1, FIG. 3 and FIG. 4, this is done in such a way that the engagement assembly 116, in use, urges the bendable elongated assembly 101 to bend and form an arched structure 118 positioned over the watercraft 900 once the bendable elongated assembly 101 is (A) extended over the watercraft 900, and (B) coupled to the watercraft 900 (and is slide engaged accordingly). The arched structure 118 (once formed) has a vertical height 120 (also called an apex height) extending over the watercraft 900. For instance, the embodiment as depicted in FIG. 3 shows the vertical height 120 is greater than the vertical height 121 of the embodiment as depicted in FIG. 4. By selectively moving the position of the engagement assembly 116 relative to (along) the bendable elongated assembly 101 (such as, moving the first engagement device 122 and the second engagement device 124 relative to each other), the vertical height 120 of the arched structure 118 may be accordingly adjustable (or user adjustable) for a predetermined amount of the vertical height 120 (located above the watercraft 900). Preferably, the tension set-up in the bendable elongated assembly 101 (once the arched structure 118 is formed) is enough to prevent the engagement assembly 116 from inadvertently slipping along a length of the bendable elongated assembly 101 (in cooperation with friction between the engagement assembly 116 and the bendable elongated assembly 101), which prevents the arched structure 118 from inadvertently collapsing onto the top section of the watercraft 900.

In accordance to an embodiment, extending, connecting and positioning the bendable elongated members (102, 104) over the watercraft 900 is improved in such a way that the bendable elongated members (102, 104) are urged to bend and form the arched structure 118 (to be positioned over the watercraft 900), in which the arched structure 118 is configured to be adjustable (geometrically adjustable and/or height adjustable) by relative selective movement (forced movement by user manipulation) between the engagement assembly 116 and the bendable elongated assembly 101.

Referring to the embodiments as depicted in FIG. 1, FIG. 3 and FIG. 4, the vertical height 120 of the arched structure 118, once formed, is selectively adjustable (by the user) in response to changing a position in which the engagement assembly 116, in use, engages along a lineal section of the bendable elongated assembly 101.

Referring to the embodiment as depicted in FIG. 1 and FIG. 7, the arched structure 118, once formed, is usable for supporting (is configured to support), at least in part, a watercraft cover 906 (which is depicted in the embodiment associated with FIG. 7). The watercraft cover 906 is receivable, at least in part, by the arched structure 118 (once formed and set-up accordingly).

Referring to the embodiment (in accordance with a second major embodiment) as depicted in FIG. 1, the apparatus 100 includes and is not limited to (comprises) a synergistic combination of a first bendable elongated member 102, a second bendable elongated member 104, a first coupler 112, a second coupler 114, and an engagement assembly 116. For instance, the engagement assembly 116 may include a first engagement device 122 and a second engagement device 124. The first bendable elongated member 102 (also called a first flat bar) and the second bendable elongated member 104 (also called a second flat bar) are extendable (configured to extend) over (a top section of) a watercraft 900.

The first coupler 112 (also called a first connector or a first fixed connector, etc.) and the second coupler 114 (also called a second connector or a second fixed connector, etc.) are configured to couple (fixedly connect) the first bendable elongated member 102 and the second bendable elongated member 104, respectively, to the watercraft 900.

The engagement assembly 116 is also called a slide engagement or a slideable sleeve, etc. The engagement assembly 116 is configured to engage (that is, slide engage) the first bendable elongated member 102 and the second bendable elongated member 104 with each other. The first bendable elongated member 102 and the second bendable elongated member 104 are each configured to bend and form an arched structure 118 that is positioned over the watercraft 900 (that is, once the first bendable elongated member 102 and the second bendable elongated member 104 are extended over the watercraft 900, are coupled to the watercraft 900, and are engaged with each other, accordingly). The arched structure 118 has an apex that is positioned at a vertical height 120 over the watercraft 900 (once the arched structure 118 is formed and set-up accordingly).

Preferably, the first engagement device 122 and the second engagement device 124 (also called two sleeves) are provided for each set of the bendable elongated members (such as, and not limited to, the first bendable elongated member 102 and the second bendable elongated member 104). The bendable elongated members may be called a flat bar set. The first bendable elongated member 102 and the second bendable elongated member 104 are flexed (arched) while the first bendable elongated member 102 and the second bendable elongated member 104 are slide connected to each other by the engagement assembly 116 (such as, the first engagement device 122 and the second engagement device 124), and then the first bendable elongated member 102 and the second bendable elongated member 104 are inserted into the first coupler 112 and the second coupler 114 (respectively).

The first engagement device 122 and the second engagement device 124 (which may be called sleeves, etc., and any equivalent thereof) are configured to give (provide) lateral strength (once the flat bar set is connected to the watercraft 900). Embodiments of the engagement assembly 116 are depicted in FIGS. 8-10.

The first bendable elongated member 102 and the second bendable elongated member 104 (also called flat bars) are configured to (A) overlap, at least in part, each other, and (B)

slide relative to each other. This is done in such a way that the first bendable elongated member 102 and the second bendable elongated member 104, in use, allow for adjustable overall width (such as, for selective installation to a particular configuration or geometry of the watercraft 900 or for readjustment of the geometry of the arched structure 118, etc.).

The first coupler 112 and the second coupler 114 (also called mounting brackets) are configured to be utilized on most types of watercraft having different gunnel sizes (geometries). The first coupler 112 and the second coupler 114 are each configured to be selectively fixedly attached to (anchored top) the hull 901 of the watercraft 900. Preferably, the first coupler 112 (and the second coupler 114) is configured to self-orient relative to a slope of the hull 901 of the watercraft 900 (this is done in such a way that the first coupler 112 and the second coupler 114, in use, provide a substantially perpendicular setting (orientation) for the first bendable elongated member 102 and the second bendable elongated member 104.

The first bendable elongated member 102 and/or the second bendable elongated member 104 are configured to slide and insert into a slot (such as a receiver 138, as depicted in FIG. 13) of the first coupler 112 and the second coupler 114, respectively (preferably without a tightening device).

By flexing the first bendable elongated member 102 and the second bendable elongated member 104, and adjusting the amount of overlap between the first bendable elongated member 102 and the second bendable elongated member 104 (for an overall desired length), the first coupler 112 and the second coupler 114, in use, are utilized for urging the first bendable elongated member 102 and/or the second bendable elongated member 104 to create tension in (A) the receiver 138 (also called a slot) of the first coupler 112 (the receiver 138 is better depicted in FIG. 13), and (B) the receiver of the second coupler 114. By flexing the first bendable elongated member 102 and the second bendable elongated member 104 (once the overall length of the first bendable elongated member 102 and the second bendable elongated member 104 is adjusted for a desired overall length), the first coupler 112 and the second coupler 114 are configured to urge a tension into the first bendable elongated member 102 and the second bendable elongated member 104 (once the first bendable elongated member 102 and the second bendable elongated are made to flex or bend).

Referring to the embodiment as depicted in FIG. 2, the second engagement device 124 (of the engagement assembly 116) is depicted as a sleeve device, a collar device, and any equivalent thereof. The second engagement device 124 is configured to slide engage a free open end of the first bendable elongated member 102 with a section of (a lineal length of) the second bendable elongated member 104.

FIG. 3, FIG. 4 and FIG. 5 each depict end views of embodiments of the apparatus 100 of FIG. 1.

The first bendable elongated member 102 (such as, a first flat bar) and the second bendable elongated member 104 (such as, a second flat bar) are configured to slide overlap (at least in part) with each other. The combination of the first bendable elongated member 102 and the second bendable elongated member 104 are configured to be length slide adjustable (relative to the outside sections or the sides of the watercraft 900).

In accordance with an embodiment, to adjust the amount of the vertical height 120 (as depicted in FIG. 3 and FIG. 4), the user may move slide the first bendable elongated member 102 along a first length of the second bendable elongated member 104 while the second engagement device 124 and the first engagement device 122 (of the engagement assembly 116) continues to slide engage the first bendable elongated member 102 with the second bendable elongated member 104.

In accordance with another embodiment, to adjust the amount of the vertical height 120, the first engagement device 122 (a first sleeve device) and the second engagement device 124 (a second sleeve device) are slide movable closer to the outer sides of the watercraft 900 (as depicted in FIG. 4), and in this manner the horizontal distance 123 between the first engagement device 122 and the second engagement device 124 is relatively smaller for the embodiment as depicted in FIG. 3 in comparison to the horizontal distance 125 of the embodiment as depicted in FIG. 4.

Referring to the embodiment as depicted in FIG. 3 and FIG. 4, the vertical height 120 of the arched structure 118, once formed, is adjustable in response to changing a position in which the engagement assembly 116, in use, engages the first bendable elongated member 102 with the second bendable elongated member 104.

Referring to the embodiment as depicted in FIG. 3 and FIG. 7, the arched structure 118, once formed, is usable for supporting (configured to support), at least in part, a watercraft cover 906 (depicted in FIG. 7) that is receivable, at least in part, by the arched structure 118.

Referring to the embodiment as depicted in FIG. 3 and FIG. 4 (in accordance with a third major embodiment), the apparatus 100 includes and is not limited to (comprises) a synergistic combination of a first bendable elongated member 102, a second bendable elongated member 104, a first coupler 112 (a first connector), a second coupler 114 (a second connector), and an engagement assembly 116. The first bendable elongated member 102 is extendable from a first gunnel 902 toward a second gunnel 904 of a watercraft 900. The second bendable elongated member 104 is extendable from the second gunnel 904 toward the first gunnel 902 of the watercraft 900. The first coupler 112 (also called a first connector) is configured to couple (such as, fixedly connect) the first bendable elongated member 102 to the first gunnel 902 of the watercraft 900. The second coupler 114 (also called a second connector) is configured to couple (such as fixedly connect) the second bendable elongated member 104 to the second gunnel 904 of the watercraft 900. The engagement assembly 116 (also called a slide engagement) is configured to engage the first bendable elongated member 102 with the second bendable elongated member 104. The first bendable elongated member 102 and the second bendable elongated member 104 are each configured to bend (resiliently flex without breaking) and form an arched structure 118 positioned at a vertical height 120 over the watercraft 900 once: (A) the first bendable elongated member 102, in use, extends from the first gunnel 902 toward the second gunnel 904 of the watercraft 900, (B) the second bendable elongated member 104, in use, extends from the second gunnel 904 toward the first gunnel 902 of the watercraft 900, (C) the first coupler 112, in use, couples the first bendable elongated member 102 to the first gunnel 902 of the watercraft 900, (D) the second coupler 114, in use, couples the second bendable elongated member 104 to the second gunnel 904 of the watercraft 900, and (E) the engagement assembly 116, in use, engages the first bendable elongated member 102 with the second bendable elongated member 104.

Referring to the embodiment as depicted in FIG. 3 and FIG. 4, the engagement assembly 116 includes a first engagement device 122 configured to slide engage the first end portion of the first bendable elongated member 102 with a first length of the second bendable elongated member 104. The engagement assembly 116 also includes a second engagement device 124 configured to slide engage the first end portion of the second bendable elongated member 104 with a second length of the first bendable elongated member 102.

Referring to the embodiment as depicted in FIG. 3 and FIG. 4, the first engagement device 122 and the second engagement device 124 are configured to selectively slide engage the first bendable elongated member 102 and the second bendable elongated member 104 at an infinite number of positions located along the first bendable elongated member 102 and the second bendable elongated member 104.

Referring to the embodiment as depicted in FIG. 3 and FIG. 4, the first coupler 112 and the second coupler 114 are configured to selectively securely couple the first bendable elongated member 102 and the second bendable elongated member 104 to the gunnels (first gunnel 902 and the second gunnel 904) of the hull 901 of the watercraft 900.

Referring to the embodiment as depicted in FIG. 3 and FIG. 4, the first bendable elongated member 102 and the second bendable elongated member 104 are also configured to be positioned adjacently to each other in such a way that the first bendable elongated member 102 and the second bendable elongated member 104, in use, slide contact and slide overlap, at least in part, each other.

Referring to the embodiment as depicted in FIG. 3 and FIG. 4, a geometric configuration of the arched structure 118, which is formed by cooperation between the first coupler 112, the second coupler 114, the first bendable elongated member 102 and the second bendable elongated member 104, is selectively adjustable to fit a geometry of the gunnels (first gunnel 902 and the second gunnel 904) of the hull 901 of the watercraft 900. This may be done by moving the position of the first engagement device 122 and the second engagement device 124 along the first bendable elongated member 102 and the second bendable elongated member 104 (relative to the opposite sides of the watercraft 900).

Referring to the embodiment as depicted in FIG. 5, the bendable elongated assembly 101 is extendable over a watercraft 900. For instance, the bendable elongated assembly 101 may include a first bendable elongated member 102, a second bendable elongated member 104 and a third bendable elongated member 105. The first bendable elongated member 102 is connectable to (supportable by) the first coupler 112. The second bendable elongated member 104 is connectable to (supportable by) the second coupler 114. The first bendable elongated member 102 and the third bendable elongated member 105 are configured to overlap (at least in part) with each other. The first engagement device 122 is configured to slide engage with the first bendable elongated member 102 and the third bendable elongated member 105. By adjusting a first position of the first engagement device 122 (position is adjusted along first bendable elongated member 102), a first amount of overlap (between the first bendable elongated member 102 and the third bendable elongated member 105) may be adjusted. The second bendable elongated member 104 and the third bendable elongated member 105 are configured to overlap (at least in part) with each other. The second engagement device 124 is configured to slide engage with the third bendable elongated member 105 and the second bendable elongated member 104. By adjusting a second position of the second engagement device 124 (position is adjusted along the second bendable elongated member 104), a second amount of overlap (between the third bendable elongated member 105 and the second bendable elongated member 104) may be adjusted.

Preferably, once the position of the first engagement device 122 and the second engagement device 124 is set, the tension held in the first bendable elongated member 102, the second bendable elongated member 104 and the third bendable elongated member 105, in use, keeps the first engagement device 122 and the second engagement device 124 from inadvertent movement. Alternatively, a lock device (known and not depicted) may be utilized to fix the position of the first engagement device 122 to the first bendable elongated member 102 and the third bendable elongated member 105. Alternatively, a lock device (known and not depicted) may be utilized to fix the position of the second engagement device 124 to the second bendable elongated member 104 and the third bendable elongated member 105.

FIG. 6 and FIG. 7 depict a top view (FIG. 6) and a side view FIG. 7 of embodiments of the apparatus 100 of FIG. 1.

Referring to the embodiments as depicted in FIG. 6 and FIG. 7, three pairs of the bendable elongated assembly 101 are positioned on the watercraft 900 in a spaced apart relationship. The three pairs of the bendable elongated assembly 101, in use, form the arched structure 118 (depicted in FIG. 3 and FIG. 4). Once the arched structure 118 is formed, the arched structure 118 is usable for supporting (configured to support), at least in part, the watercraft cover 906. The watercraft cover 906 is receivable, at least in part, by the arched structure 118 that is formed by the three pairs of the bendable elongated assembly 101.

FIG. 8, FIG. 9 and FIG. 10 depict perspective views of embodiments of the apparatus 100 of FIG. 1.

Referring to the embodiments as depicted in FIG. 8, FIG. 9 and FIG. 10, the first bendable elongated member 102 and the second bendable elongated member 104 include elongated flexible flat bars configured to selectively contact and selectively slide overlap, at least in part, with each other.

Referring to the embodiments as depicted in FIG. 8, FIG. 9 and FIG. 10, the first coupler 112 and the second coupler 114 are each configured to confine sliding engagement of the overlapping sections of the elongated flexible bars once the first bendable elongated member 102 and the second bendable elongated member 104, in use, slide overlap each other.

Referring to the embodiments as depicted in FIG. 8, FIG. 9 and FIG. 10, the engagement assembly 116 is also configured to selectively clamp the overlapping sections of the first bendable elongated member 102 and the second bendable elongated member 104 to each other in such way that the elongated flexible bars, in use, do not slide relative to each other.

Referring to the embodiments as depicted in FIG. 8, FIG. 9 and FIG. 10, the engagement assembly 116 include a collar that fit over and slide engage the overlapping portions of the first bendable elongated member 102 and the second bendable elongated member 104 once the first bendable elongated member 102 and the second bendable elongated member 104 are respectively supported by the couplers.

FIG. 11 and FIG. 12 depict perspective views of the apparatus 100 of FIG. 1.

Referring to the embodiment as depicted in FIG. 11 and FIG. 12, the first coupler 112 is configured to self-correct for a slope of the hull 901 of the watercraft 900, and thereby form a perpendicular setting for the first coupler 112 and the first bendable elongated member 102. The first bendable elongated member 102 is configured to be inserted into a receiver 138 (depicted in FIG. 13) defined by the first coupler 112. By flexing the first bendable elongated member 102 (once the overall length of the first bendable elongated member 102 and the second bendable elongated member 104 is adjusted for overall length), the first coupler 112 and the clamp assembly 130 are configured (in cooperation) to urge tensioning of the first bendable elongated member 102 (and the second bendable elongated member 104) once the first bendable elongated member 102 and the second bendable elongated member 104 are slide coupled to each other, and once the first coupler 112 is secured to the side wall of the watercraft 900.

FIG. 13, FIG. 14 and FIG. 15 depict a front view (FIG. 13), a side view (FIG. 14) and a perspective view (FIG. 15) of embodiments of the coupler assembly 111 of the apparatus 100 of FIG. 1.

Referring to the embodiments as depicted in FIGS. 13, 14 and 15, the coupler assembly 111 is configured to selectively receive, at least in part, the first gunnel 902 (or the second gunnel 904) of the watercraft 900. The first gunnel 902 extends from the hull 901 of the watercraft 900. Preferably, the coupler assembly 111 includes (defines) a gunnel-receiving zone 126 configured to surround, at least in part, the first gunnel 902. The gunnel-receiving zone 126 forms an angled interior structure configured to contact opposite sides of the first gunnel 902.

The coupler assembly 111 includes a clamp assembly 130 having a handle assembly 132 mounted to a rotatable shaft 134. The handle assembly 132 is configured to be rotatable. A protection portion 136 (a rubber portion) is mounted to a tip section of the rotatable shaft 134. The coupler assembly 111 is configured to receive and support the rotatable shaft 134 for rotational threaded movement. The protection portion 136 is configured to contact the inner portion of the hull 901 (at a position below the first gunnel 902).

The coupler assembly 111 includes an extension member 137 (an arched portion) configured to make contact with the outside section of the hull 901 of the watercraft 900 at a position located below the first gunnel 902. The extension member 137 may include a rubber portion (so that the outer section of the hull 901 is not inadvertently marked up or scratched).

The coupler assembly 111 provides (defines) a receiver 138 configured to slide receive and support (at least in part) a distal end section of the first bendable elongated member 102 (or the second bendable elongated member 104, etc.). This is done in such a way that the first bendable elongated member 102 extends away from the first gunnel 902 of the watercraft 900.

The following is offered as further description of the embodiments, in which any one or more of any technical feature (described in the detailed description, the summary and the claims) may be combinable with any another one or more of any technical feature (described in the detailed description, the summary and the claims). It is understood that each claim in the claims section is an open ended claim unless stated otherwise. Unless otherwise specified, relational terms used in these specifications should be construed to include certain tolerances that the person skilled in the art would recognize as providing equivalent functionality. By way of example, the term perpendicular is not necessarily limited to 90.0 degrees, and may include a variation thereof that the person skilled in the art would recognize as providing equivalent functionality for the purposes described for the relevant member or element. Terms such as "about" and "substantially", in the context of configuration, relate generally to disposition, location, or configuration that are either exact or sufficiently close to the location, disposition, or configuration of the relevant element to preserve operability of the element within the invention which does not materially modify the invention. Similarly, unless specifically made clear from its context, numerical values should be construed to include certain tolerances that the person skilled in the art would recognize as having negligible importance as they do not materially change the operability of the invention. It will be appreciated that the description and/or drawings identify and describe embodiments of the apparatus 100 (either explicitly or inherently). The apparatus 100 may include any suitable combination and/or permutation of the technical features as identified in the detailed description, as may be required and/or desired to suit a particular technical purpose and/or technical function. It will be appreciated that, where possible and suitable, any one or more of the technical features of the apparatus 100 may be combined with any other one or more of the technical features of the apparatus 100 (in any combination and/or permutation). It will be appreciated that persons skilled in the art would know that the technical features of each embodiment may be deployed (where possible) in other embodiments even if not expressly stated as such above. It will be appreciated that persons skilled in the art would know that other options would be possible for the configuration of the components of the apparatus 100 to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the word "includes" is equivalent to the word "comprising" in that both words are used to signify an open-ended listing of assemblies, components, parts, etc. The term "comprising", which is synonymous with the terms "including," "containing," or "characterized by," is inclusive or open-ended and does not exclude additional, unrecited elements or method steps. Comprising (comprised of) is an "open" phrase and allows coverage of technologies that employ additional, unrecited elements. When used in a claim, the word "comprising" is the transitory verb (transitional term) that separates the preamble of the claim from the technical features of the invention. The foregoing has outlined the non-limiting embodiments (examples). The description is made for particular non-limiting embodiments (examples). It is understood that the non-limiting embodiments are merely illustrative as examples.

What is claimed is:

1. An apparatus for use with a watercraft cover, and for use with a bendable elongated member, and for use with a watercraft including a hull having an inside hull section and an outside hull section, and the watercraft also including a gunnel extending from a top section of the hull, and the gunnel having a top side and opposite lateral sides depending from the top side, and the apparatus comprising:

a coupler assembly defining a gunnel-receiving zone being sized to receive a section of the gunnel of the watercraft; and the gunnel-receiving zone of the coupler assembly being positionable proximate to the top side and said opposite lateral sides of the gunnel of the watercraft once the gunnel-receiving zone receives the section of the gunnel of the watercraft; and the coupler assembly extending over the top side of the gunnel, and the coupler assembly also extending along the opposite lateral sides of the gunnel of the watercraft once the gunnel-receiving zone receives the section of the gunnel of the watercraft; and the coupler assembly positioned over a portion of the inside hull section and a segment of the outside hull section of the hull once the gunnel-receiving zone receives the section of the gunnel of the watercraft; and a rotatable shaft being threadably rotatably supported by the coupler assembly for threaded rotational movement of the rotatable shaft toward the inside hull section of the hull; and a handle assembly being mounted to the rotatable shaft; and a rubber portion being mounted to a tip section of the rotatable shaft; and the rubber portion being contactable with the inside hull section of the hull of the watercraft at a position located proximate to, and below, the gunnel once the gunnel-receiving zone is positioned proximate to the top side and said opposite lateral sides of the gunnel of the watercraft, and once the handle assembly and the rotatable shaft are rotated to move the rubber portion toward the inside hull section of the hull; and the coupler assembly including an extension member extending along the outside hull section of the hull of the watercraft once the gunnel-receiving zone of the coupler assembly is positioned proximate to the top side and said opposite lateral sides of the gunnel of the watercraft; and the extension member having a rubber end portion being contactable with the outside hull section of the hull of the watercraft at a position located distally from, and below, the gunnel once the gunnel-receiving zone is positioned proximate to the top side and said opposite lateral sides of the gunnel of the watercraft; and the coupler assembly defining a slot; and the slot being aligned along an obtuse angle being subtended between the top side of the gunnel and the slot once the gunnel-receiving zone of the coupler assembly is positioned proximate to the top side and said opposite lateral sides of the gunnel of the watercraft; and the slot being sized to slideably receive and support a distal end section of the bendable elongated member so that the bendable elongated member extends over the watercraft once the distal end section of the bendable elongated member is received by the slot; and whereby the bendable elongated member supports a piece of the watercraft cover after the portion of the watercraft cover is placed on the bendable elongated member while the slot slideably receives and supports the distal end section of the bendable elongated member, and the bendable elongated member extends from the slot and over the watercraft.

2. An apparatus for use with a watercraft cover, and for use with a watercraft including a hull having an inside hull section and an outside hull section, and the watercraft also including a gunnel extending from a top section of the hull, and the gunnel having a top side and opposite lateral sides depending from the top side, and the apparatus comprising:

a bendable elongated member; and a coupler assembly defining a gunnel-receiving zone being sized to receive a section of the gunnel of the watercraft; and the gunnel-receiving zone of the coupler assembly being positionable proximate to the top side and said opposite lateral sides of the gunnel of the watercraft once the gunnel-receiving zone receives the section of the gunnel of the watercraft; and the coupler assembly extending over the top side of the gunnel, and the coupler assembly also extending along the opposite lateral sides of the gunnel of the watercraft once the gunnel-receiving zone receives the section of the gunnel of the watercraft; and the coupler assembly positioned over a portion of the inside hull section and a segment of the outside hull section of the hull once the gunnel-receiving zone receives the section of the gunnel of the watercraft; and a rotatable shaft being threadably rotatably supported by the coupler assembly for threaded rotational movement of the rotatable shaft toward the inside hull section of the hull; and a handle assembly being mounted to the rotatable shaft; and a rubber portion being mounted to a tip section of the rotatable shaft; and the rubber portion being contactable with the inside hull section of the hull of the watercraft at a position located proximate to, and below, the gunnel once the gunnel-receiving zone is positioned proximate to the top side and said opposite lateral sides of the gunnel of the watercraft, and once the handle assembly and the rotatable shaft are rotated to move the rubber portion toward the inside hull section of the hull; and the coupler assembly including an extension member extending along the outside hull section of the hull of the watercraft once the gunnel-receiving zone of the coupler assembly is positioned proximate to the top side and said opposite lateral sides of the gunnel of the watercraft; and the extension member having a rubber end portion being contactable with the outside hull section of the hull of the watercraft at a position located distally from, and below, the gunnel once the gunnel-receiving zone is positioned proximate to the top side and said opposite lateral sides of the gunnel of the watercraft; and the coupler assembly defining a slot; and the slot being aligned along an obtuse angle being subtended between the top side of the gunnel and the slot once the gunnel-receiving zone of the coupler assembly is positioned proximate to the top side and said opposite lateral sides of the gunnel of the watercraft; and the slot being sized to slideably receive and support a distal end section of the bendable elongated member so that the bendable elongated member extends over the watercraft once the distal end section of the bendable elongated member is received by the slot; and whereby the bendable elongated member supports a piece of the watercraft cover after the portion of the watercraft cover is placed on the bendable elongated member while the slot slideably receives and supports the distal end section of the bendable elongated member, and the bendable elongated member extends from the slot and over the watercraft.

3. An apparatus for use with a watercraft cover, and the apparatus comprising:

a watercraft including a hull having an inside hull section and an outside hull section, and the watercraft also including a gunnel extending from a top section of the hull, and the gunnel having a top side and opposite lateral sides depending from the top side; and a bendable elongated member; and a coupler assembly defining a gunnel-receiving zone being sized to receive a section of the gunnel of the watercraft; and the gunnel-receiving zone of the coupler assembly being positionable proximate to the top side and said opposite lateral sides of the gunnel of the watercraft once the gunnel-receiving zone receives the section of the gunnel of the watercraft; and the coupler assembly extending over the top side of the gunnel, and the coupler assembly also extending along the opposite lateral sides of the gunnel of the watercraft once the gunnel-receiving zone receives the section of the gunnel of the watercraft; and the coupler assembly positioned over a portion of the inside hull section and a segment of the outside hull section of the hull once the gunnel-receiving zone receives the section of the gunnel of the watercraft; and a rotatable shaft being threadably rotatably supported by the coupler assembly for threaded rotational movement of the rotatable shaft toward the inside hull section of the hull; and a handle assembly being mounted to the rotatable shaft; and a rubber portion being mounted to a tip section of the rotatable shaft; and the rubber portion being contactable with the inside hull section of the hull of the watercraft at a position located proximate to, and below, the gunnel once the gunnel-receiving zone is positioned proximate to the top side and said opposite lateral sides of the gunnel of the watercraft, and once the handle assembly and the rotatable shaft are rotated to move the rubber portion toward the inside hull section of the hull; and the coupler assembly including an extension member extending along the outside hull section of the hull of the watercraft once the gunnel-receiving zone of the coupler assembly is positioned proximate to the top side and said opposite lateral sides of the gunnel of the watercraft; and the extension member having a rubber end portion being contactable with the outside hull section of the hull of the watercraft at a position located distally from, and below, the gunnel once the gunnel-receiving zone is positioned proximate to the top side and said opposite lateral sides of the gunnel of the watercraft; and the coupler assembly defining a slot; and the slot being aligned along an obtuse angle being subtended between the top side of the gunnel and the slot once the gunnel-receiving zone of the coupler assembly is positioned proximate to the top side and said opposite lateral sides of the gunnel of the watercraft; and the slot being sized to slideably receive and support a distal end section of the bendable elongated member so that the bendable elongated member extends over the watercraft once the distal end section of the bendable elongated member is received by the slot; and whereby the bendable elongated member supports a piece of the watercraft cover after the portion of the watercraft cover is placed on the bendable elongated member while the slot slideably receives and supports the distal end section of the bendable elongated member, and the bendable elongated member extends from the slot and over the watercraft.

* * * * *